US005428865A

United States Patent [19]

Yarbrough

[11] Patent Number: 5,428,865

[45] Date of Patent: Jul. 4, 1995

[54] WATER-FILTERED VACUUM SANDER

[76] Inventor: Glen A. Yarbrough, 3913 Schenley St., Enon, Ohio 45323

[21] Appl. No.: 12,616

[22] Filed: Feb. 2, 1993

Related U.S. Application Data

[63] Continuation of Ser. No. 743,876, Aug. 12, 1991, which is a continuation-in-part of Ser. No. 579,889, Sep. 10, 1990, abandoned.

[51] Int. Cl.[6] ..... A47L 9/18; A47L 5/00; B24B 55/06

[52] U.S. Cl. ..... 15/353; 15/396; 55/248; 451/354; 451/456

[58] Field of Search ..... 15/353, 393, 396, 397; 51/180, 273, 170 R, 292; 55/248, 244, 246

[56] References Cited

U.S. PATENT DOCUMENTS

| | | | |
|---|---|---|---|
| 1,575,939 | 3/1926 | Satterwhite et al. | 15/393 X |
| 1,839,582 | 1/1932 | Nordhem | 55/248 |
| 1,846,706 | 2/1932 | Cartmell | 55/248 |
| 2,221,572 | 11/1940 | Brock et al. | 55/248 |
| 2,240,005 | 4/1941 | Moyer | 15/393 X |
| 2,314,986 | 3/1943 | Johnson | 55/249 |
| 3,490,208 | 1/1970 | Meyer et al. | 15/353 |
| 3,775,951 | 12/1973 | Eicholz et al. | 15/353 |
| 4,062,152 | 12/1977 | Mehrer | 51/273 |
| 4,226,000 | 10/1980 | Tribolet | 15/353 |
| 4,246,676 | 1/1981 | Hallsworth et al. | 15/353 |
| 4,476,608 | 10/1984 | Rasmussen | 15/353 |
| 4,704,142 | 11/1987 | Dukic, Jr. | 15/353 |
| 4,759,155 | 7/1988 | Shaw | 51/180 |
| 4,826,514 | 5/1989 | Griffis | 15/353 |
| 4,851,016 | 7/1989 | Rylander | 55/248 |
| 4,937,984 | 7/1990 | Taranto | 51/180 |
| 4,964,243 | 10/1990 | Reiter | 51/180 |
| 5,007,206 | 4/1991 | Paterson | 51/170 R |
| 5,022,115 | 6/1991 | Kasper | 15/353 |
| 5,125,129 | 6/1992 | Kasper et al. | 15/353 |
| 5,193,313 | 3/1993 | Sanchez et al. | 51/170 R |

*Primary Examiner*—David A. Scherbel
*Assistant Examiner*—Tony G. Soohoo
*Attorney, Agent, or Firm*—Donald P. Gillette

[57] ABSTRACT

Sanding apparatus in which dust raised by sanding is drawn by reduced pressure through a porous sanding sheet and directly through apertures into a plenum chamber and from there through an air passage into an air space in a closed container partially filled with water. The air and dust are separated in the container by projecting the dust into the water from a small distance above it and, simultaneously, drawing the substantially dust-free air out of the air space by the reduced pressure so that the air does not need to enter the water.

4 Claims, 1 Drawing Sheet

WATER-FILTERED VACUUM SANDER

This is a continuation of application Ser. No. 743,876, filed Aug. 12, 1991, which is a continuation-in-part of application Ser. No. 579,889, filed Sep. 10, 1990 and now abandoned.

BACKGROUND OF THE INVENTION

1. Field of the Invention

This invention relates to the field of sanding devices to be used to smooth dry walls and the like. In particular, it relates to sanding apparatus having a pivotally mounted head capable of reaching and pressing flat against wall locations over a wide area, from those close at hand to those well beyond the reach of the operator, to sand away excess joint cement and to draw the particles of grit by vacuum into a water trap via an air lock.

2. The Prior Art

In sanding dry walls to remove excess joint cement or plaster, it is desirable to do so over a widely spaced areas of wall surface without the operator's having to move far from a fixed location and, in particular, having to climb a ladder to reach the upper part of the wall. In modern houses having cathedral ceilings, this requires attaching abrasive material to a head mounted on a pole.

The head has a flat surface across which is stretched a sheet of abrasive material, such as sandpaper, sanding screen, and other such sheets of material, and it is necessary to keep the flat surface as flat against the wall as possible, whether the location being sanded at any instant is rather close to the operator or is some distance away, high or low or to either side of the operator.

Romine, U.S. Pat. No. 4,697,389, describes a vacuum sander using sandpaper on a solid block attached to a pole. Neither the block nor the sandpaper has apertures that would permit dust and air to pass through, and so the block is surrounded by a shroud that draws in not only the dust created by sanding but a great deal of air from the surrounding area. This requires that the vacuum cleaner have a high capacity to move air, all of which, including that laden with dust, will directly enter the vacuum cleaner, since Romine does not provide a water filter.

Mehrer, U.S. Pat. No. 4,062,152, describes a vacuum sanding device in which a hollow pole connected to a vacuum source is mounted on a universal swivel in the sanding head. Openings formed in the pole adjacent the mount allow dust-laden air drawn through a sanding screen and through an apertured plate into a chamber surrounding those openings to enter the pole directly and be moved along to the vacuum source. Part of the walls of the chamber are defined by a somewhat flexible boot of special shape that allows the pole to be pivoted through a limited solid angle. As in the Romine patent, no water filtration is suggested by Mehrer.

OBJECTS AND SUMMARY OF THE INVENTION

It is an object of this invention to provide a simple sanding device having a hollow handle through which the dust produced by the sanding operation can be carried by a stream of air drawn along by a vacuum source. The dust is projected down onto the surface of water in a container to be entrapped by the water, but the carrier stream, now freed of dust, does not enter the water. Instead, it moves through air space above the water and enters a second air passage through which it continues to the vacuum source.

A further object is to make it possible to sand widely spaced areas of a large wall from a single location while keeping the abrasive surface not only flat against the wall but aligned both horizontally and vertically with edges of the wall.

Sanding apparatus in accordance with this invention comprises a sanding head with a hollow plenum chamber and an apertured front face. A compliant, apertured sheet of sponge rubber or the like is affixed to the front surface of the face, and means are provided to stretch a sheet of porous sanding material across the compliant sheet. The apertures in the sheet are aligned with those in the front face so that air laden with dust can be drawn through the porous sanding material and both sets of apertures directly into the plenum chamber. From there the dust-filled air is drawn into an air passage leading to a closed container partially filled with water. That air passage terminates in an air space directly above, and aimed at, the surface of the water. The air and dust are moved along the passage as a result of reduced pressure produced in the air space by a vacuum cleaner or the like connected to a second opening through a wall of the container.

The head has a universal swivel to which a hollow pole can be attached so that an operator standing in a single location can use this apparatus to sand widely spaced areas of a large wall. The universal swivel allows the pole to pivot to any position within a wide, solid angle relative to the head, and the sanding material can thus be kept flat against the wall and in alignment, both horizontally and vertically, with edges of the wall.

In order to increase the arcuate extent of the solid angle and to provide a swivel attachment that can transmit a large force to the sanding material, the exhaust opening from the plenum chamber does not pass through the swivel but is laterally displaced from it, and the swivel is mounted firmly on the plenum chamber. Further to this purpose, the swivel has a short receptacle into which a first end of the pole is inserted. The pole is closed air-tight at that end, and a separate air entrance to the interior of the pole is provided at a location spaced a short distance from that end. A first flexible hose substantially longer than the shortest straight-line distance between the exhaust opening and the entrance location connects the exhaust opening of the plenum chamber to the pole to allow the head to swivel widely in all directions relative to the pole.

This invention will be described in greater detail hereinafter in conjunction with the drawings in which the same parts in different figures will be identified by the same reference numerals.

DESCRIPTION OF A PREFERRED EMBODIMENT

Figure 1:
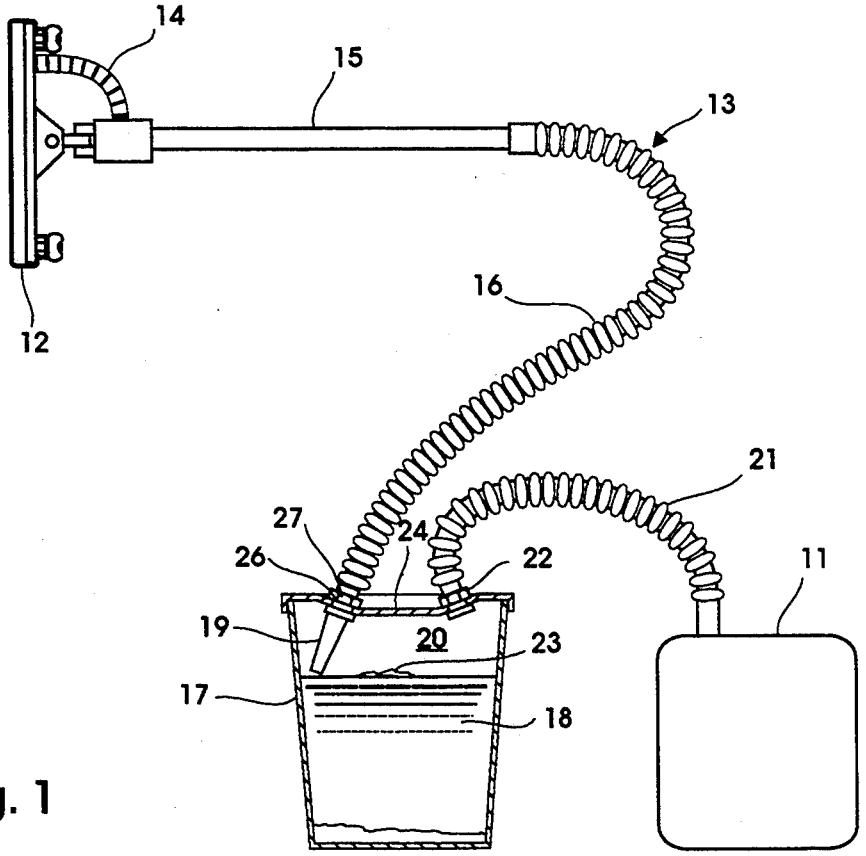
FIG. 1 shows one embodiment of sanding apparatus according to this invention.

FIG. 1 shows apparatus for sanding a dry wall and simultaneously removing the dust by means of an exhaust pump 11, typically in the form of a vacuum cleaner. The apparatus includes a sanding head 12 having a porous sanding surface through which dust raised by the sanding operation passes to a first air passage 13 that comprises a flexible hose 14, a handle 15, and a hose 16 in this embodiment. At the output end of the hose 16 is a closed container 17 only partially filled with water 18, and the air passage 13 terminates in a tube 19 inside the container just above the surface of the water and aimed at that surface so that the dust will be projected at the water 18 and will be captured thereby.

The air that carries the dust is pulled through the porous sanding surface and into the air passage 13 by the difference in pressure between the ambient pressure at the surface being sanded and the lower pressure in the air space 20 above the water 18 in the container. The reduced air pressure is produced by the exhaust pump 11, which is connected by a third hose 21 to a fitting 22 that serves as an exit opening from the container 17. The level to which the container is to be filled with water while in use is indicated by a mark 23 on the wall of the container.

The container 17 may be made of any convenient material, such as polyethylene, and it has a cover 24 that fits tightly enough to prevent air from seeping in between the container and the cover. The fitting 22 is preferably near one side of the cover, and a second fitting 26 diametrically opposite the fitting 22, and preferably also in the cover 24, receives the hose 16. In this embodiment, the cover has a shallow frusto-conical part 27, and it is preferable to locate both of the fittings 22 and 26 in diametrically opposite regions of the frusto-conical part so that the tube 19 and the exit opening in the fitting 22 will be directed slightly away from each other. In a typical container 17 that is about 14" tall, the mark 23 may be about 7" below the rim, and the tube 19 should terminate above that level and below the bottom end of the fitting 22 far enough so that dust from the sanding operation will eject from the tube directly into the water 18 to be captured by the water. The air with which the dust was mixed as it moved along the air passage 13 should not pass into the water but, stripped of substantially all dust, should be pulled onward through a second air passage, comprising the fitting 22 and the hose 21, into the vacuum cleaner 11. The air space 20 thus constitutes an air lock, and the vacuum cleaner only has to receive substantially dust-free air. As a result, there is no dust flying about. In order to provide adequate separation between the end of the tube 19 and the fitting 22, the end of the tube should be between about ¼" and 3" above the mark 23 denoting the surface of the water. I have found that the best location for the end of the tube 19 is between about ½" and 1" above the mark 23.

Figure 2:
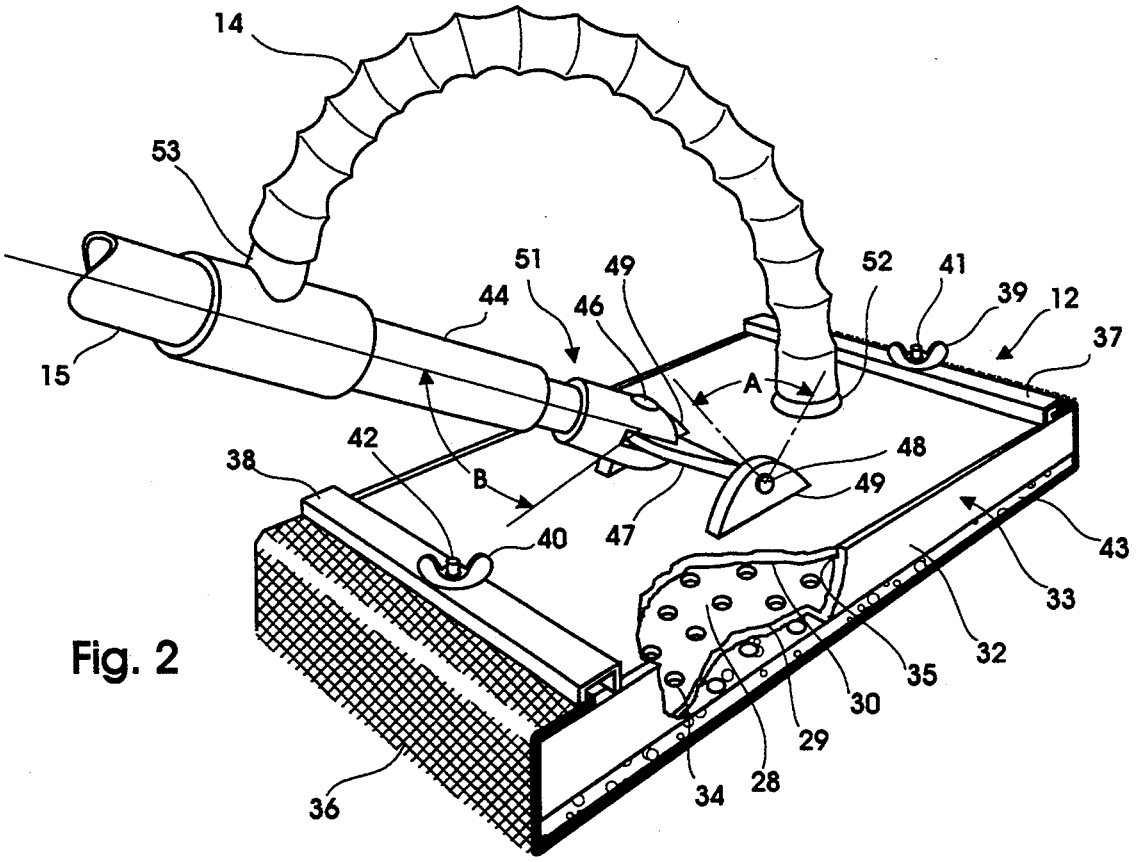
FIG. 2 is a perspective view of a sanding head for use in the apparatus of FIG. 1.

As shown in greater detail in FIG. 2, the head 12 comprises a hollow plenum chamber 28 between rectangular front and rear walls 29 and 30, respectively, and surrounded by low side walls 32. In this embodiment, the front and side walls are molded as a one-piece structure 33 of a suitable, durable plastic material and the front wall has a plurality of apertures 34 through it. The side walls are formed with an internal step 35, and in this embodiment, the rear wall 30 is a metal casting that fits snugly between the upper edges of the side walls 32 and rests on the step. The structure 33 in held in place on the rear wall by a piece of sanding material 36 stretched across the front face and wrapped around the ends of the plenum chamber and secured under clamps 37 and 38. These clamps are metal extrusions of U-shaped cross-section and are held in place by wing nuts 39 and 40 threaded onto screws 41 and 42 that, in turn, are screwed into the rear wall 30 near opposite ends thereof. A deformable sheet 43 of material, such as sponge rubber or the like, having apertures aligned with the apertures 34 is attached to the front surface of the front wall 29 between the front surface and the sanding material to permit the sanding material to conform to lumps on the wall being sanded, and the apertures and the plenum chamber may be considered part of the first air passage 13.

One end of the handle 15 is inserted into one end of a close-fitting receptacle 44 to be firmly gripped thereby so that the receptacle forms part of the handle. The other end of the receptacle is closed off so that no air can pass through it and is formed as a fork pivotally mounted on a first pin 46 that permits the handle to pivot to either side over a wide angle B of as much as 90° measured relative to the center line in the long dimension of the head 12. The pin 46, in turn, is in a block 47 pivotally mounted on a second pin 48 inserted in trunnions 49 formed on the rear surface of the rear wall 30. The axis of the pin 48 is perpendicular to the axis of the pin 46 to allow the handle to swing fore and aft through an angle A measured relative to a plane perpendicular to the rear wall 30 and to the long dimension of the plenum chamber. The components 46–49 constitute a sturdy universal swivel 51 that not only allows the handle to swing to any position within a solid angle of large arcuate extent but also allows the head 12 to be aligned in any desired direction, such as parallel to horizontal or vertical edges of a wall being sanded and to be pressed hard against that wall during the sanding operation.

Some prior sanding and vacuuming devices mounted on a hollow handle and intended to be pivoted or swiveled to some extent arrange to pass sand an air directly to the open end of the handle, which is held in somewhat flexible spring mounting means or, in the Mehrer device, in a somewhat flexible boot. Such an arrangement tends to be weak or to restrict pivotal movement of the handle. The present invention does not suffer from such limitations, because air and dust drawn directly through the porous sanding material 36 and the plenum chamber 28 do not enter the handle 15 directly but reach it via the flexible hose 14, one end of which is joined airtight to a fitting 52 in the rear wall 30. The fitting 52, which defines an outlet for the plenum chamber 28, is laterally displaced from the universal swivel to allow the handle 15 to swing through a larger solid angle. The other end of the flexible hose 14 is attached to a side extension 53 that forms an entrance into the receptacle portion at one end of the handle 15, and the length of the hose 14 is greater than the shortest distance between the outlet of the plenum chamber and the entrance to the handle. Preferably, the flexible hose 14 is long enough to reach from the outlet of the plenum chamber to the entrance to the handle 15 when the handle is pivoted directly away from the fitting 52 and is substantially flat against the rear wall 30. This allows the angle A to have a value close to 90° in either direction relative to a plane perpendicular to the rear wall 30 and to the long dimension of the head 12. While it will rarely, if ever, be necessary or even desirable to pivot the handle to those extremes, it is shown in FIG. 2 as being displaced at an angle A of about 45° and an angle B of about 60° from a position perpendicular to the rear wall 30 without any hindrance.

While this invention has been described in terms of a specific embodiment, it will be understood by those skilled in the art that modifications may be made therein without departing from the true scope of the invention.

What is claimed is:

1. A sanding apparatus comprising:

(a) a sanding head comprising:

(i) a plenum chamber having a plurally apertured front wall to receive air mixed with sanding dust, a rear wall, and an exhaust opening through which the air mixed with sanding dust can escape from the chamber, (ii) a layer of deformable material affixed to the front wall and defining a flat front surface, the deformable material comprising apertures substantially aligned with apertures in said front wall, and (iii) means to releasably hold a sheet of porous sanding material across said apertured front wall;

(b) a hollow handle having:

(i) a first end physically connected to said sanding head, (ii) a second end from which to expel the air mixed with sanding dust; and (iii) entrance means connected to said hollow handle and said exhaust opening for receiving the air mixed with dust from said sanding head and directing said air to said hollow handle, said hollow handle comprising a first part extending from the first end to said entrance means and a second part extending from said entrance means to said second end;

(c) first air passage means comprising:

(i) said second end of said hollow handle, (ii) an outlet end portion, (iii) a flexible hose connecting said second end of said hollow handle to the outlet end portion;

(d) a container to hold water at a predetermined water level, said container comprising a side wall and an open top;

(e) a cover having a perimeter releasably fitted onto said container across the open top to form an airtight seal about the open top between the cover and the side wall;

(f) means for indicating a predetermined water level in said container when said container is partially filled with water, thereby defining an air space bounded by said side wall, the surface of said predetermined water level, and said cover;

(g) an exit opening through said cover and adjacent an edge of said cover;

(h) an entrance opening through said cover disposed diametrically opposite to said exit opening and connected to said outlet end portion to admit air from said outlet end portion of said first air passage means into said air space, said entrance opening having a perimeter connected airtight to said outlet end portion of said first air passage means, said outlet end portion of said first air passage means terminating in said air space below said cover and above the predetermined water level and aimed generally away from said exit opening and downwardly at an angle toward the surface of the water; and (i) second air passage means comprising an entrance end connected airtight to the exit opening of said container and further connected to means for producing reduced air pressure in said container, thereby drawing air out of the air space and projecting the sanding dust from said plenum chamber through said first air passage into the water to substantially separate said dust from the air.

2. The sanding apparatus of claim 1 in which:

(a) the cover has a shallow frusto-conical central part, and said outlet end portion of said first air passage means and the entrance end of the second air passage means are in diametrically opposite outer regions of the frusto-conical part, whereby said outlet end portion of said first air passage means and said entrance end portion of said second air passage means are directed angularly away from each other.

3. The sanding apparatus of claim 1 in which the outlet end portion of the first air passage means terminates between about $\frac{1}{4}''$ and 3" above the predetermined water level 4. The sanding apparatus of claim 1 in which the outlet end portion of the first air passage means terminates between about $\frac{1}{2}''$ and 1" above the predetermined water level.

* * * * *